US005367810A

United States Patent [19]

Stead et al.

[11] Patent Number: 5,367,810

[45] Date of Patent: Nov. 29, 1994

[54] MAGAZINE

[75] Inventors: Heyns W. Stead, Pretoria; Anthony S. Neophytou, Verwoerdburg, both of South Africa

[73] Assignee: Ikon Ltd., Amsterdam, Netherlands

[21] Appl. No.: 24,504

[22] Filed: Mar. 1, 1993

[30] Foreign Application Priority Data

Mar. 3, 1992 [ZA] South Africa ..... 92/1580

[51] Int. Cl.[5] ..... F41A 9/72

[52] U.S. Cl. ..... 42/17; 42/49.01; 89/33.04

[58] Field of Search ..... 42/6, 10, 11, 17, 21, 42/24, 29, 33, 35, 37, 39, 49.01; 89/33.04

[56] References Cited

U.S. PATENT DOCUMENTS

| | | | |
|---|---|---|---|
| 552,864 | 1/1896 | Browning | 42/21 |
| 560,348 | 5/1896 | Dinsmore | 42/17 |
| 803,389 | 10/1905 | Bernard | 42/17 |
| 809,640 | 1/1906 | Stow | 42/21 |
| 1,360,188 | 11/1920 | Croy | 42/11 |
| 1,481,042 | 1/1924 | Walther et al. | 42/17 |
| 1,561,011 | 11/1925 | Nelson | 42/21 |
| 1,709,399 | 4/1929 | Herlach et al. | 89/33.04 |
| 3,665,631 | 5/1972 | Domian et al. | 42/17 |

FOREIGN PATENT DOCUMENTS

| | | | |
|---|---|---|---|
| 1130035 | 1/1957 | France | 42/17 |
| 142404 | 5/1920 | United Kingdom | 42/17 |
| 9118255 | 11/1991 | WIPO . | |

OTHER PUBLICATIONS

Swearengen, T. F. "The World's Fighting Shotguns", Alexandria, Va. Chesa Limited pp. 299–304.

*Primary Examiner*—Stephen C. Bentley
*Attorney, Agent, or Firm*—Ladas & Parry

[57] ABSTRACT

A magazine for a firearm includes at least one tubular member for receiving a plurality of cartridges. The tubular member is displaceably mountable on the firearm to permit displacement between an inoperative position for receiving fresh cartridges and an operative position for dispensing cartridges from the tubular member into a barrel of the firearm. A gate member is pivotally mounted at an open end of the tubular member and has a protuberance in the path of an end cartridge to inhibit ejection of the cartridge from the tubular member. The gate member co-operates with a loading mechanism of the firearm and is operable to displace the gate member out of such path.

8 Claims, 8 Drawing Sheets

MAGAZINE

This invention relates to a magazine for use with a firearm particularly, but not necessarily exclusively, a pump action firearm.

According to the invention there is provided a magazine for a firearm which includes at least one tubular member for receiving a plurality of cartridges, the tubular member being displaceably mountable on the firearm to permit displacement between an inoperative position for receiving fresh cartridges and an operative position for dispensing cartridges from the tubular member into a barrel of the firearm; and a gate member pivotally mounted at an open end of the tubular member and having a protuberance in the path of an end cartridge to inhibit ejection of the cartridge from the tubular member, the gate member cooperating with a loading mechanism of the firearm and being operable to displace the gate member out of such path.

The magazine may have a plurality of tubular members arranged in side by side relationship, and the magazine may then include at least one catch member at an end region of the tubular members for preventing ejection of an end cartridge from one tubular member while a cartridge is being ejected from another tubular member.

The catch member may be pivotally mounted in a pivot block and may be in the form of a plate having a nose on opposite sides of its end remote from its pivotal mounting, the plate being pivotable to cause each nose to project into the open end of one tubular member to prevent ejection of an end cartridge from that tubular member while an end cartridge from another tubular member is being ejected. The catch member may be cammed alternately into one of the tubular members by the end cartridge in the other tubular member. The pivot block may be arranged at an open end region of the tubular member.

The magazine may include a selector member for controllably selecting a particular tubular member from which the cartridges are to be ejected. When two tubular members are provided, the selector member may be arranged selectively to control ejection from either one or the other tubular member or from both of the tubular members alternately.

When the magazine is intended for use with a pump action firearm, the gate member may include a shank pivotally mounted in the pivot block. The shank may have at least one outwardly extending wing formation forming a protuberance in the path of the end cartridge in the tubular member, the gate member having an actuating member operable, when the firearm is pumped, to displace the protuberance out of the path of the end cartridge.

The magazine may include biassing means for urging the cartridges towards the open end of the tubular member. The biassing means may be in the form of a piston housed in the tubular member and urged by a coil spring towards the open end of the tubular member. The piston may have a leading end which is narrower than its trailing end so as not to foul the catch member when the cartridges from a particular tubular member are exhausted.

The tubular member may have a loading catch biassed towards a latching position for retaining an end cartridge after it has been loaded into the tubular member, the loading catch being displaceable out of the path of the cartridge as the cartridge is being loaded into the tubular member.

The magazine may further include an anti-double feed member for preventing the ejection of more than one cartridge from the tubular member when the gate member is displaced out of the path of the end cartridge. The anti-double feed member may include a resiliently flexible plate having a pair of wing formations protruding into the path of the end cartridges and being displaceable out of such path by the loading mechanism.

The invention extends also to a firearm having a magazine as above described and which includes guide rails for guiding cartridges ejected from the magazine prior to being inserted into a barrel of the firearm, and a feed member mounted rearwardly of the magazine and which is movable between inoperative and operative positions for urging cartridges ejected from the magazine onto the guide rails. The feed member may be held in its inoperative position by a pivotable tripper mechanism which is mounted in the path of a cartridge being ejected from the magazine.

The magazine may be pivotally mounted on the firearm. The magazine may then have an engagement formation for engaging the magazine on the firearm and a releasable locking device for releasably locking the magazine in its operative position. Additionally or instead, the magazine may be removably mounted on the firearm.

Various embodiments of the invention are now described by way of example, with reference to the accompanying drawings.

Figure 1:
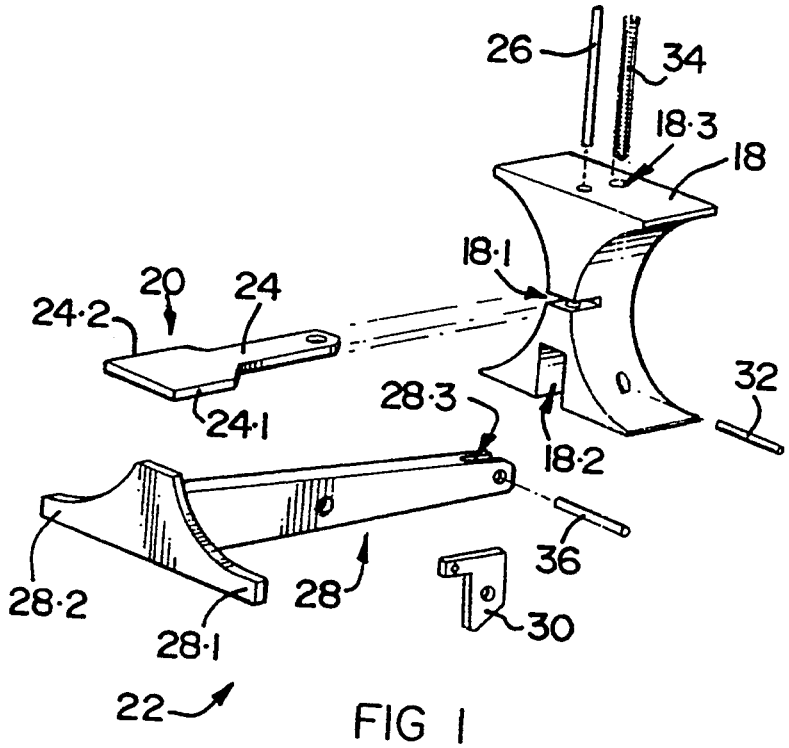
FIG. 1 shows an exploded three dimensional view of a portion of a magazine in accordance with the invention.

Referring to FIGS. 1 to 8, reference numeral 10 generally indicates a magazine for use with a pump action firearm 12.

In all the embodiments illustrated, the magazine 10 has a pair of tubular members 14, 16 arranged in side by side parallel relationship for containing a plurality of cartridges stacked along their respective longitudinal axes. A pivot block 18 is arranged intermediate the tubular members 14 and 16 at their open ends 14.1 and 16.1. A catch member 20 and a gate member 22 are each pivotally mounted in the pivot block 18.

The catch member 20 is in the form of a plate 24 which is pivotally mounted in a slot 18.1 of the pivot block 18 via a pin 26. The plate 24 has a pair of noses 24.1 and 24.2 on opposite sides of its end remote from its pivotal mounting. A pair of elongate opposite facing slots 14.2 and 16.2 located at the open ends 14.1 and 16.1 of the tubular members 14 and 16 respectively, allow the noses 24.1 and 24.2 to act as a laterally swinging latch, the significance of which will become apparent hereinafter.

The gate member 22 comprises an upwardly pivoting shank 28 and a pivotal actuating member 30. The shank 28 is pivotally mounted in a slot 18.2 of the pivot block 18 via a pin 32 and has a pair of outwardly extending wing formations 28.1 and 28.2. The shank 28 is biassed by a coil spring 34, to pivot upwardly towards a position where the formations 28.1 and 28.2 form protuberances at the ends 14.1 and 16.1, the significance of which will become apparent hereinafter. The spring 34 is housed within an aperture 18.3 in the pivot block 18. The member 30 is pivotally mounted in a slot 28.3 of the shank 28 via a pin 36 and is shaped to allow camming engagement with a lug 38 (shown in FIGS. 5 to 8) which is integrally formed with and extends outwardly from a barrel 40 of the firearm 12. In operation, when the firearm 12 is pumped forwardly the lug 38 engages the member 30 to cause downward pivotal displacement of the wing formations 28.1 and 28.2 away from the open ends 14.1 and 16.1, the significance of which will become apparent later.

Each tubular member 14 and 16 has biassing means for urging the cartridges contained within the tubular members 14 and 16 towards their open ends 14.1 and 16.1. The biassing means is in the form of a piston 42 urged by a coil spring 44 towards the open ends 14.1 and 16.1. Each piston 42 has a leading edge 42.1 which is narrower than its trailing edge 42.2 so as not to swing the plate 24 laterally and thereby not foul the catch member 20 when the cartridges from one of the tubular members 14 or 16 are exhausted.

Figure 3:
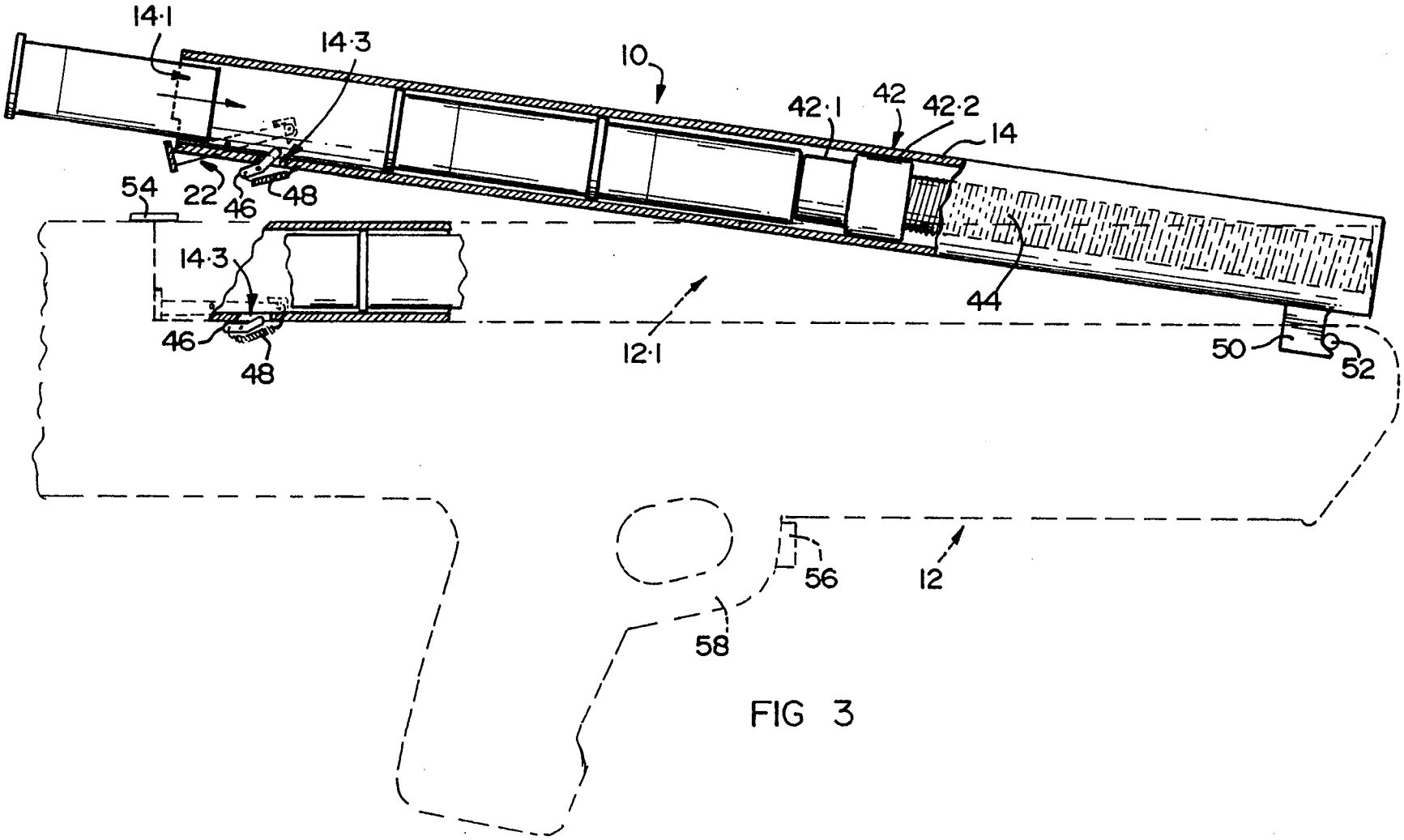
FIG. 3 shows a schematic partly sectioned side view of the magazine during its engagement with a pump action firearm.

As shown in FIG. 3, each tubular member 14 and 16 has a pivotally mounted loading catch 46 which assists during loading of fresh cartridges into the magazine 10. The catch 46 extends through a slot 14.3 in the tubular member 14 and a similar catch 46 extends through a slot (not shown) in the tubular member 16. Each loading catch 46 is biassed towards a latching position extending into the members 14 and 16 by a spring 48 and is pivotally displaced out of its latching position by the leading edge of the cartridge when the cartridge is loaded into one of the tubular members 14 or 16. The catch 46 then returns to its biassed condition to engage the trailing end of the cartridge once the cartridge has passed the catch 46 to retain the cartridge in the members 14 or 16 and prevents ejection of the cartridges therefrom.

The firearm 12 has a magazine well 12.1 for releasably receiving the magazine 10 therein. The magazine 10 has at its forward end an engagement formation 50 which pivotally engages a pin 52 mounted within the well 12.1. The longitudinal axis of the magazine 10 is normally substantially parallel to the longitudinal axis of the barrel 40 when received by the well 12.1. The magazine 10 is pivotally displaceable between a position (shown in solid lines) for loading fresh cartridges and an operative dispensing position (shown in dotted lines). A releasable locking device 54, used to lock the magazine 10 in its operative condition in the well 12.1, is mounted on the rear open end of the well 12.1. The locking device 54 is actuated by an actuator 56 mounted on a forward end of a trigger guard 58 to release the magazine 10.

While the magazine 10 is located within the well 12.1, the loading catches 46 are displaced outwardly from their biassed position within the tubular members 14 and 16 and thus out of the path of the cartridges contained within the tubular members 14 and 16. The cartridges are then urged rearwardly towards the open ends 14.1 and 16.1 by the pistons 42. The loading catches 46 thus play a role only while the magazine is moved away from the firearm 12 to its cartridge loading position.

Figure 2:
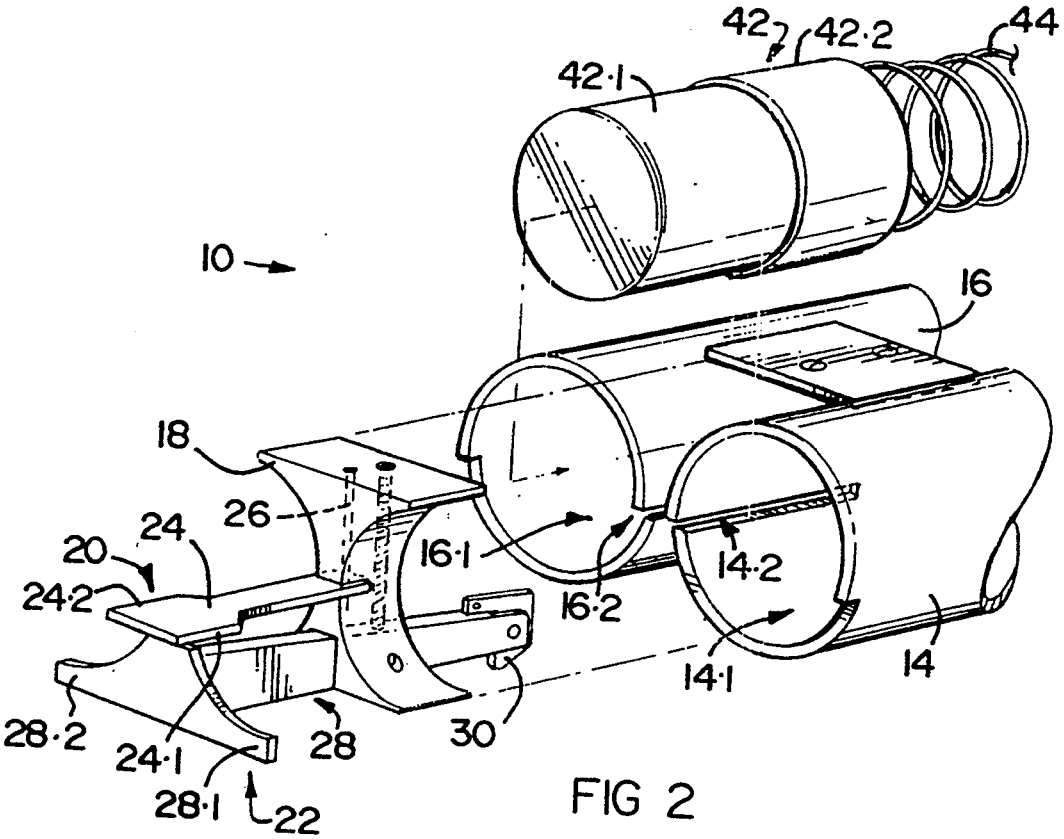
FIG. 2 shows an exploded three dimensional view of a greater portion of the magazine.
Figure 4:
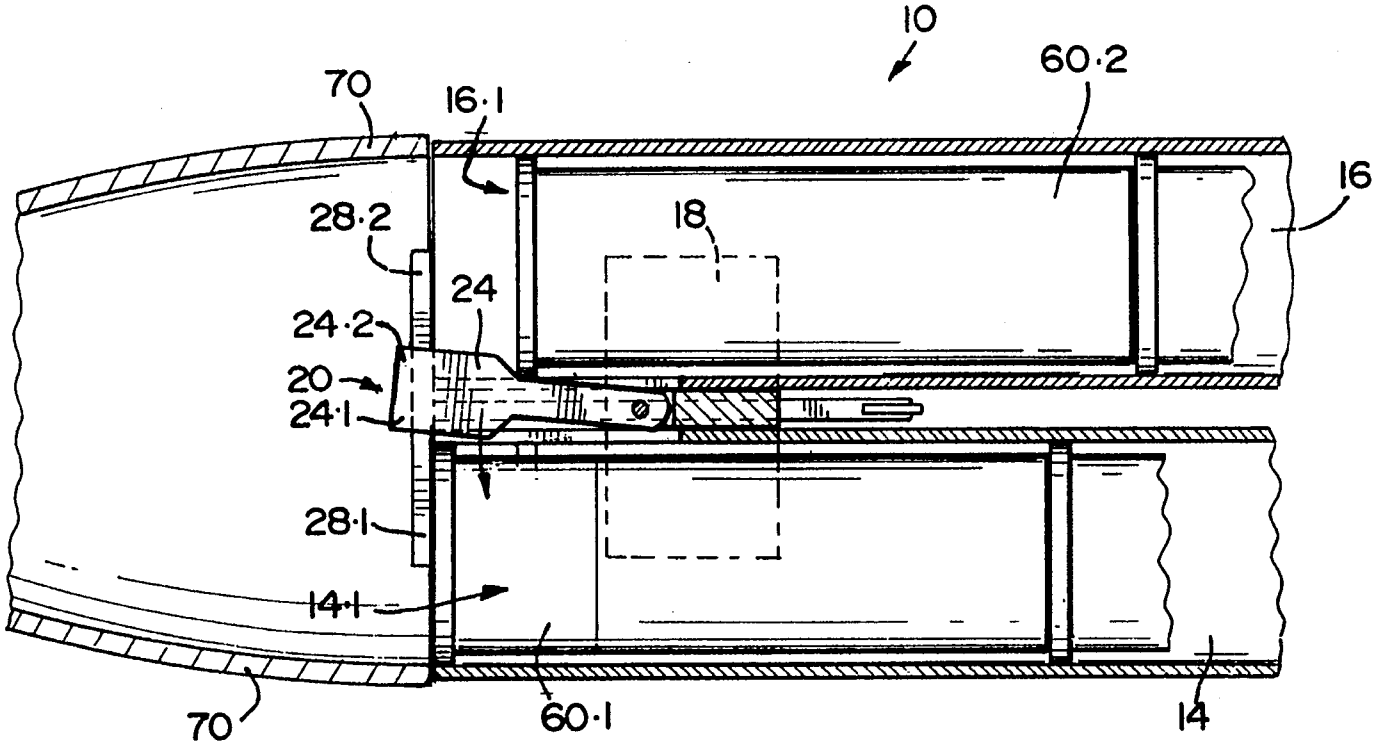
FIG. 4 shows a schematic sectional plan view of a portion of the magazine and the firearm.

FIG. 4 shows the magazine 10 in an operative condition within the well 12.1. A rearmost cartridge 60.1 is held in an ejection position at the open end 14.1 of the tubular member 14 by the wing formation 28.1. A cartridge 60.2 is held away from the open end 16.1 of the tubular member 16 by the nose 24.2. The nose 24.2 is swung laterally into the tubular member 16 via the slot 16.2 (as shown in FIG. 2) and protrudes into the path of the cartridge 60.2 to prevent ejection of the cartridge 60.2 from the member 16 while the cartridge 60.1 is in an ejection position. The nose 24.2 is held in this position by the periphery of the cartridge 60.1.

A funnel 70 is shaped to guide a cartridge ejected from the members 14 or 16 towards a loading position within the firearm 12.

Figure 5:
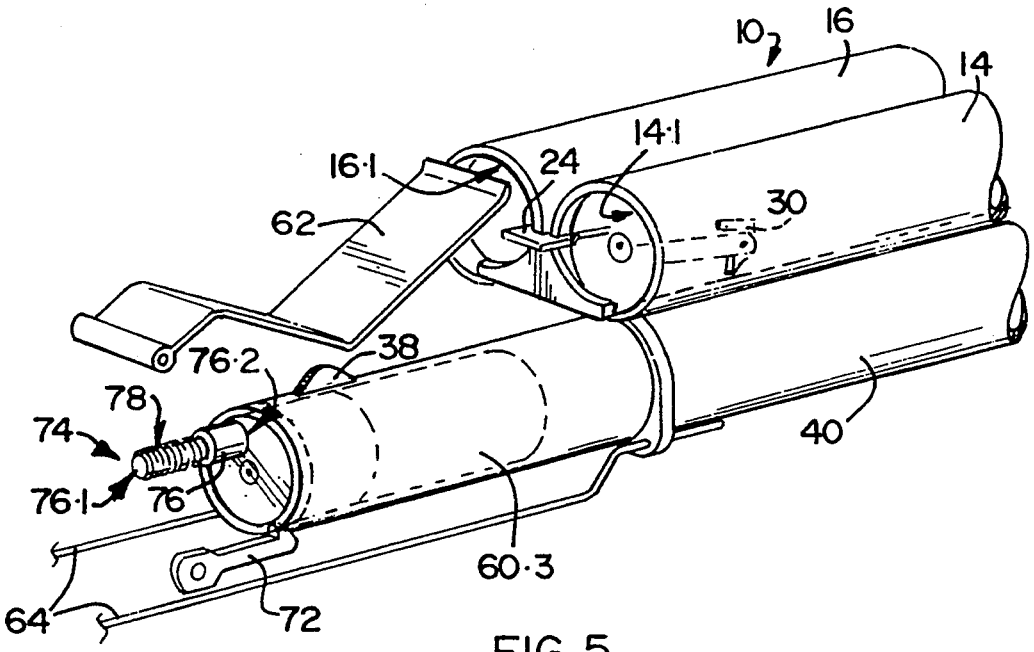
FIG. 5 shows a schematic three dimensional view of a portion of the magazine and the firearm while a cartridge is in a loaded position within a barrel of the firearm.
Figure 6:
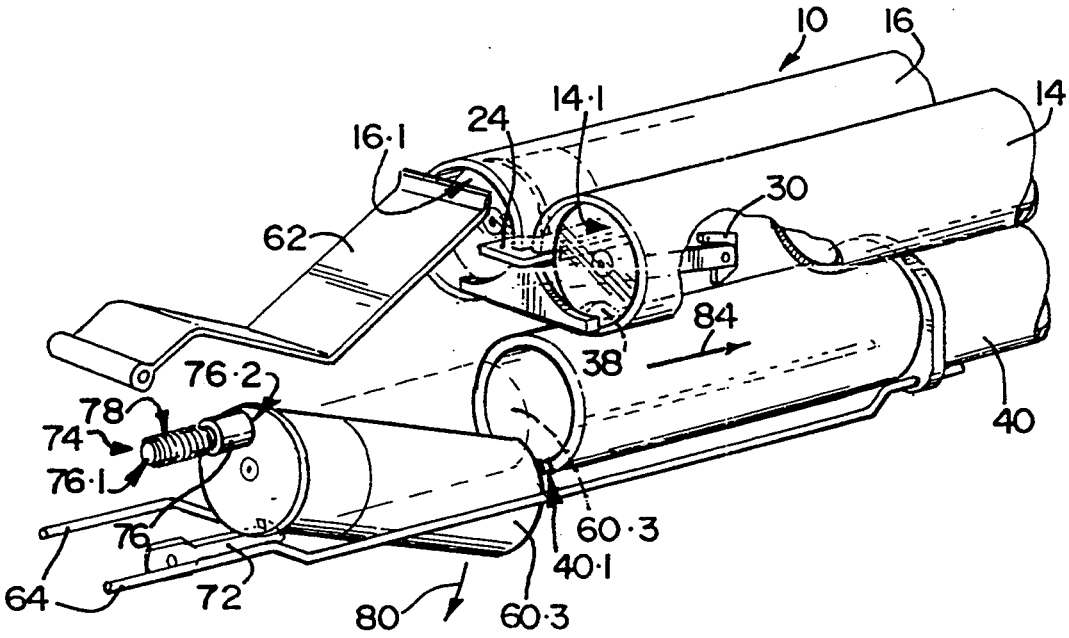
FIG. 6 shows a schematic three dimensional view corresponding to FIG. 5 during ejection of a cartridge from the firearm.
Figure 7:
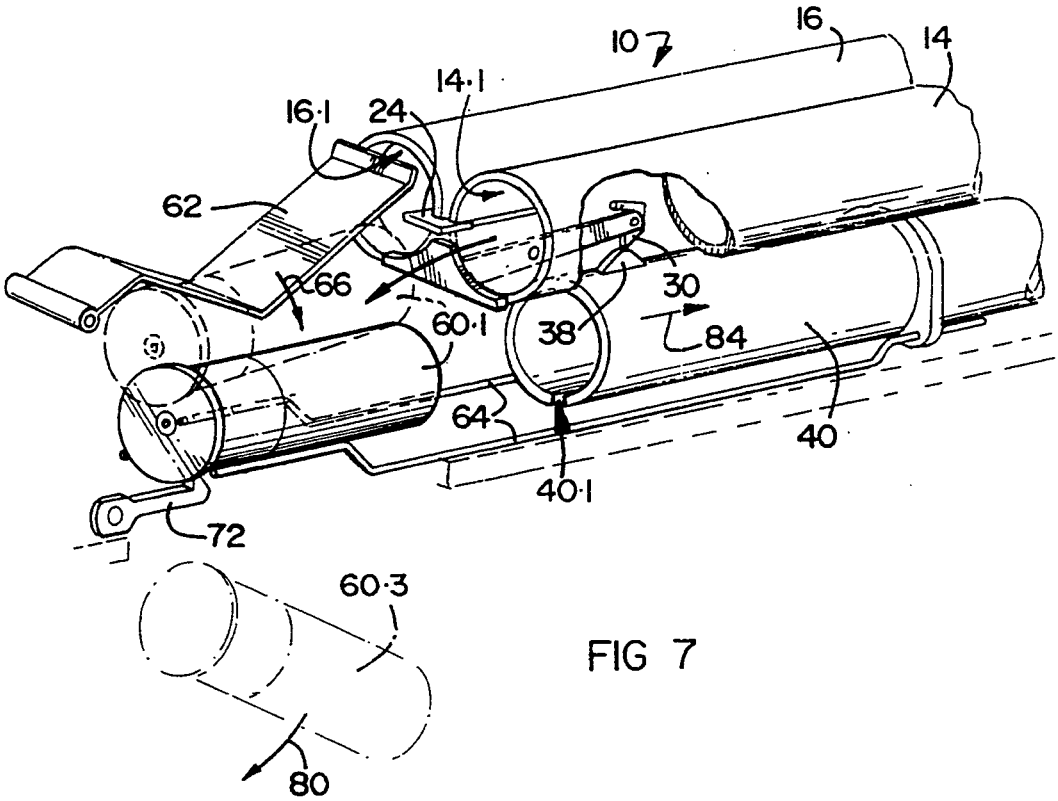
FIG. 7 shows a schematic three dimensional view corresponding to FIG. 5 during an initial stage of loading a cartridge into a barrel of the firearm.
Figure 8:
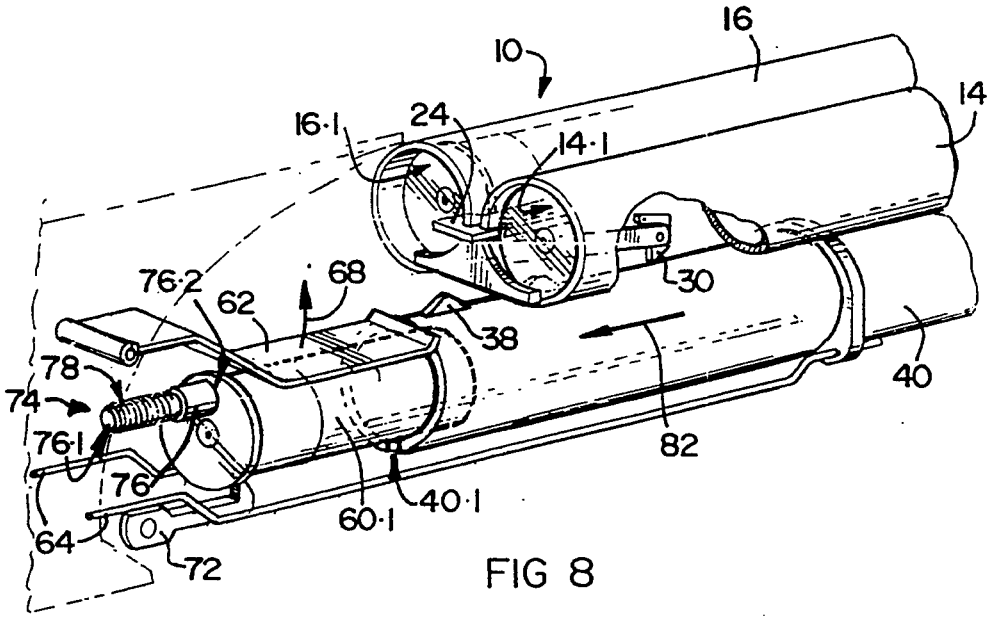
FIG. 8 shows a schematic three dimensional view corresponding to FIG. 7 during a final stage of loading the cartridge.

Referring also to FIGS. 5 to 8, an upwardly pivoting feed member 62 is shown. The feed member 62 is connected to the barrel 40 via connection means (not shown) and is pivoted downwardly in the direction of arrow 66 (as shown in FIG. 7) during the forward pump stroke, in the direction of arrow 84, of the barrel 40. In its operative condition, the feed member 62 holds a cartridge 60.1 in position on a pair of spaced parallel longitudinal rods 64. The member 62 is pivoted upwardly (as shown in FIG. 8) in the direction of arrow 68 on the rearward pump stroke of the barrel 40. In its upward and inoperative condition (as shown in FIGS. 5 to 7), the feed member 62 causes downward deflection of a cartridge which is ejected from either of the tubular members 14 or 16 towards the rods 64. The member 62 acts together with the funnel 70 of FIG. 4 during movement of the cartridge from the magazine to a position prior to being loaded into the barrel 40.

The longitudinal rods 64 are connected to the barrel 40 and move together with the barrel 40 when the barrel is pumped forwardly or rearwardly. Rear end portions of the rods 64 (as shown in FIG. 7) have a relatively narrow spacing so as to catch and support a cartridge along its length upon ejection of the cartridge from the magazine 10. Forward portions of the rods 64 (as shown in FIG. 6) are spaced more widely apart to permit ejection of a cartridge from the firearm 12 between the rods.

FIG. 6 shows a cartridge 60.3 being ejected from the firearm 12 in the direction of arrow 80 after firing once the barrel 40 is pumped forwardly in the direction of arrow 84 over a distance corresponding to the length of the cartridge 60.3. The cartridge 60.3 is prevented from moving forward with the barrel 40 by an extractor member 72 which engages the rear of the cartridge 60.3. The cartridge 60.3 is ejected from the firearm 12 by an ejector member 74 positioned at the rear end of the cartridge 60.3. The ejector member 74 is in the form of a circular shaft 76, with a trailing edge 76.1 narrower than its leading edge 76.2, and a coil spring 78 complementally mounted thereon. The leading edge 76.2 is positioned to engage the rear of the cartridge 60.3 in an off-center position and thereby urges the cartridge 60.3 pivotally downwardly in the direction of arrow 80 towards, and thereafter through, an aperture in a butt (not shown) of the firearm 12.

Referring also to FIG. 7, the cartridge 60.1 is ejected from the magazine 10 when the lug 38 engages the member 30 during the forward pumping of the barrel 40. The camming engagement between the lug 38 and member 30 causes the gate 22 to pivot downwardly out of the path of the cartridge 60.1. The cartridge 60.1 is then urged out of the tubular member 14 by the piston 42 and is then guided by the funnel 70 and feed member 62 onto the rods 64. Further forward displacement of the barrel 40 causes the feed member 62 to pivot downwardly and hold the cartridge 60.1 in position on the rods 64 (as shown in FIG. 8).

As shown in FIG. 8, the barrel 40 is then displaced rearwardly in the direction of arrow 82. During such rearward displacement the rods 64 are simultaneously rearwardly displaced. The rods 64 and feed member 62 however retain the cartridge 60.1 in position until the cartridge 60.1 is complementally and slidably received into the barrel 40. Further rearward displacement of the barrel 40 causes the feed member 62 to be pivoted upwardly in the direction of arrow 68 out of the path of the barrel 40. The rods 64 are simultaneously displaced rearwardly out of their support condition. In its fully rearward position, the barrel 40 complementally and slidably receives the entire cartridge 60.1 including the rim of the cartridge 60.1 which is engaged by the extractor member 72 via a notch 40.1 in the barrel 40. The firearm 12 can then be fired and the ejection and loading process repeated.

Figure 9:
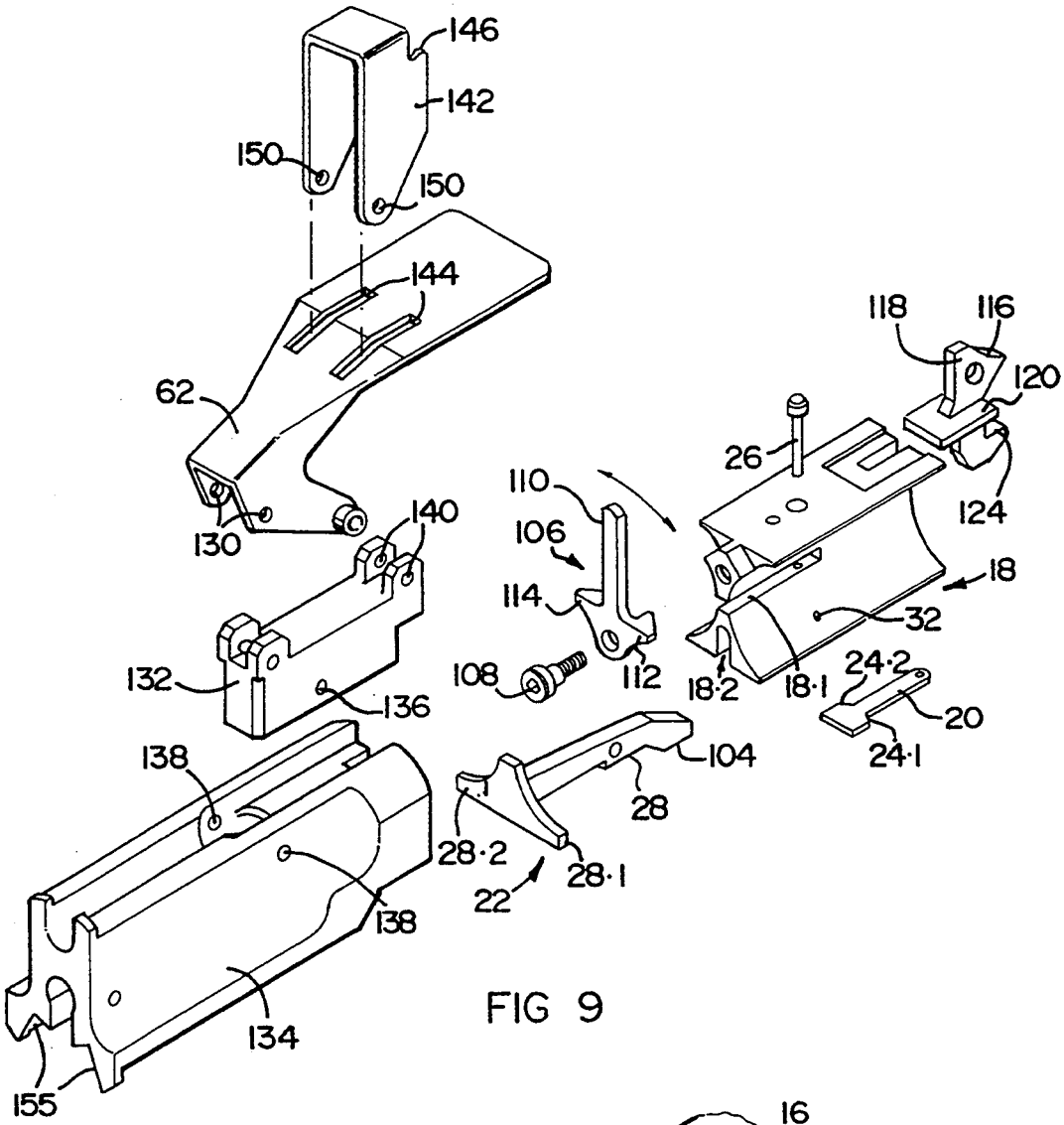
FIG. 9 shows an exploded three dimensional view of a portion of the magazine in accordance with another embodiment of the invention.

Another embodiment of the invention is illustrated in FIGS. 9 to 15. For purposes of convenience, the same reference numerals are used to refer to similar parts. In FIG. 9, the pivot block 18 is considerably longer than in the previous embodiment, effectively housing the entire length of the shank 28 of the gate member 22. The member 30 illustrated in FIGS. 1 and 2 and the lug 38 extending outwardly from the barrel 40 of the firearm 12, are omitted in the FIGS. 9 to 15 embodiment. Instead a sliding gate 100 (FIGS. 12 to 14), described in greater detail hereinafter, is provided with an actuating bridge 102 shaped to engage cam fashion with a downwardly extending end portion 104 of the shank 28.

The gate 22 is again biassed towards a position such that the wing formations 28.1 and 28.2 form protuberances at the ends 14.1 and 16.1 (FIGS. 10 and 11) of the tubular members 14 and 16. The biassing spring 34 in FIG. 1 is not shown in FIG. 9.

Figure 14:
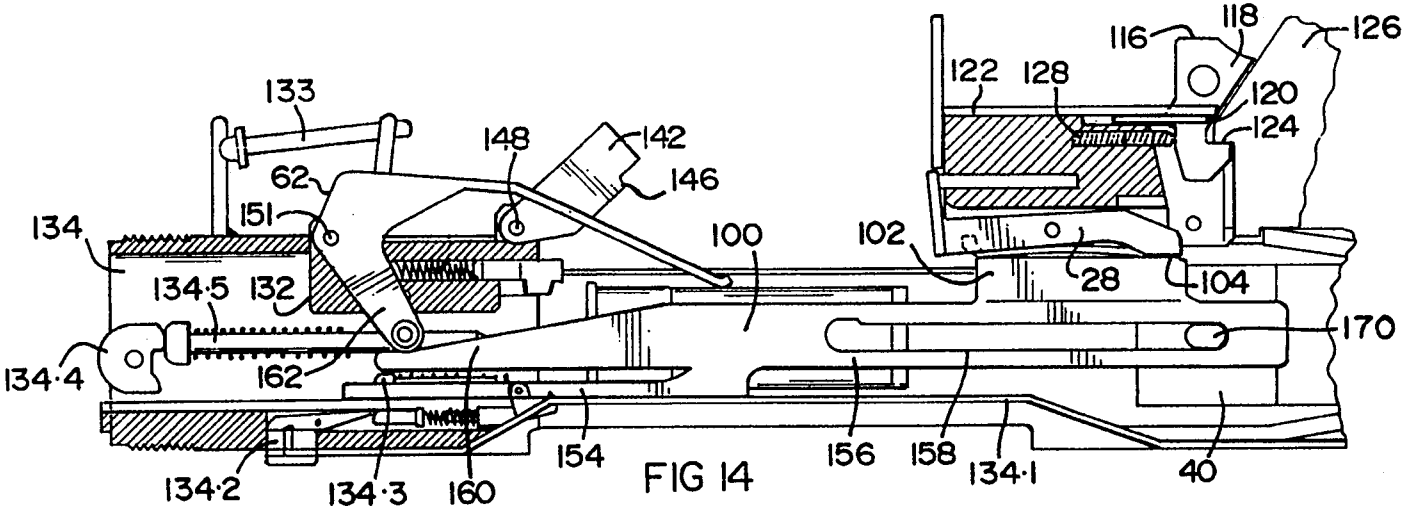
FIG. 14 is a partly sectioned side view of the portion of the magazine and firearm corresponding to FIG. 13 with the barrel pumped forwardly to a cartridge loading position.

As shown in FIG. 14, when the barrel 40 is pumped forwardly, the bridge 102 engages a lower surface of the end 104 of the shank 28 to cause downward pivotal displacement of the wing formations 28.1 and 28.2 away from the open ends 14.1 and 16.1 to permit the ejection of cartridges from the tubular members 14 and 16 as described in more detail hereinafter.

The loading catches 46 illustrated in FIG. 3 have also been dispensed with in the present embodiment. Instead, use is made of a selector 106 pivotally mounted on the pivot block 18 about a shoulder screw 108. The selector 106 includes an upwardly extending lever 110 provided with a pair of laterally extending lower nose formations 112, 114. Either one of the formations 112, 114 can be pivoted into the path of the cartridges to be ejected from the tubular members 14, 16. This allows the feeding of cartridges to be controlled from only one of the tubular members 14, 16 at a time and provides for the option of allowing alternate feeding of cartridges from the tubular member 14, 16 as is described in more detail hereinafter.

The selector 106 furthermore facilitates the loading of cartridges into the magazine 10. By pivoting the selector 106 into the path of one of the tubular members 14, 16, the other tubular member 14, 16 may be loaded, whereafter the selector 106 is pivoted into the path of the open end 14.1 or 16.1 of the loaded tubular member 14 or 16 to facilitate loading of the other tubular member 16 or 14. During the loading of each tubular member 14, 16, the corresponding wing formation 28.1 or 28.2 of the gate member 22 retains the loaded cartridges within the tubular member 14 or 16 being loaded.

Figure 13:
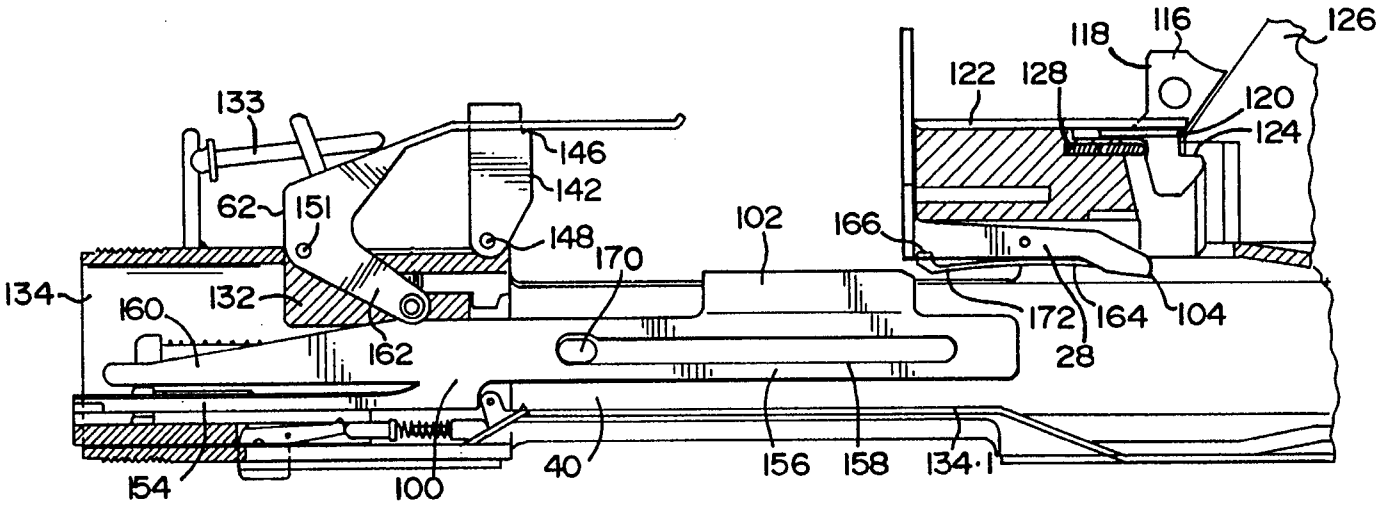
FIG. 13 is a partly sectioned side view of a portion of the magazine illustrated in FIG. 9 during its engagement with a pump action firearm, with a barrel of the firearm pumped rearwardly to a firing position.

The locking device 54 and actuator 56 of the previous embodiment are replaced by a magazine catch 116 illustrated in FIGS. 9, 13 and 14. The magazine catch 116 comprises an actuator 118 mounted vertically in a horizontal sliding plate 120. When assembled, the sliding plate 120 is slidably housed between the pivot block 18 and a bridge plate 122 connecting the tubular members 14, 16 as shown more clearly in FIG. 10. The actuator 118 extends downwardly and is provided with a locking formation 124 at its lower end to engage a handle 126 of the firearm 12 as illustrated in FIGS. 13 and 14. Referring to FIGS. 13 and 14, the magazine catch 116 is biassed forwardly by a compression spring 128 thereby allowing the locking formation 124 to engage a complementary recess in the handle 126. To release the magazine 10 in order to permit it to be pivoted upwardly for loading purposes, the magazine catch 116 is slid backwardly to disengage the locking formation 124 from the recess in the handle 126.

Referring to FIGS. 9, 13 and 14, the feed member 62 has a modified configuration. It has apertures 130 for pivotally mounting the feed member 62 on a pivot block 132 and is biassed in a clockwise direction by a compression spring (not shown) provided on a pin 133. The pivot block 132, in turn, is releasably secured to a breech block 134 by means of a locating pin (not shown) receivable in apertures 136 and 138 in the pivot block 132 and the breech block 134 respectively. The pivot block 132 is provided with a further pair of apertures 140 for pivotally mounting a tripper member 142. The breech block 134 has a substantially conventional trigger arm 134.1, a sear 134.2, a firing rod 134.3, a firing hammer 134.4 and firing pin 134.5.

The tripper member 142 comprises a U-shaped bracket, the legs of which are receivable in complementary slots 144 in the feed member 62, and define forwardly extending nose formations 146. The legs of the tripper member 142 are pivotally mounted by means of a pin 148 (FIGS. 13 and 14) passed through the holes 140 in the pivot block 132 and aligned holes 150 in the legs of the tripper member 142. The tripper member 142 is biased to pivot in a clockwise direction by means of a spring (not shown). This urges a front edge of the legs of the tripper member 142 against a portion of the feed member 62 defining the front end of the slots 144.

When the barrel 40 is pumped all the way to the rear as illustrated in FIG. 13, the nose formations 146 of the tripper member 142 engage a lower surface of the feed member 62 thereby supporting the feed member 62 in its upward or inoperative position. The feed member 62 is biassed in a clockwise direction as mentioned above. Disengagement of the nose formations 146 from the feed member 62 by moving the tripper member 142 in an anti-clockwise direction causes the feed member 62 to pivot about its pivotal axis defined by a pin 151 extending through the apertures 130, in a clockwise direction to its operative position. The tripper member 142 is displaced in an anti-clockwise direction by a cartridge when the cartridge is ejected from the magazine thereby to release the feed member 62.

Figure 12:
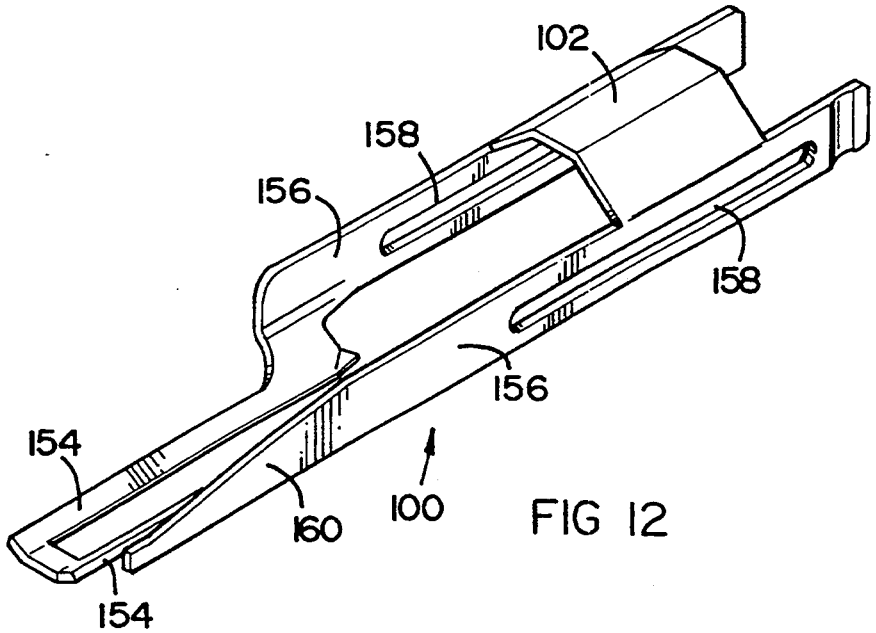
FIG. 12 shows a three dimensional view of a sliding gate forming part of the magazine illustrated in FIG. 9.

Referring to FIGS. 12, 13 and 14, the longitudinal rods 64 of the previous embodiment are replaced by the sliding gate 100. The sliding gate 100 defines a pair of guide rails 154 which run in guides 155 (FIG. 9) in the breech block 134 and which perform essentially the same function as the rods 64. A front end of the guide rails 154 is formed integrally with side walls 156 defining longitudinally extending slots 158. The side walls 156 are connected by means of the bridge 102 which performs a camming function as briefly mentioned above and as described in greater detail hereinafter. The one side wall 156 extends rearwardly to provide a cam member 160. When the barrel 40 is pumped rearwardly, the cam member 160 engages a downwardly extending leg 162 of the feed member 62 thereby urging the feed member 62 in an anti-clockwise direction about the pin 151 to its inoperative position as illustrated in FIG. 13.

Figure 10:
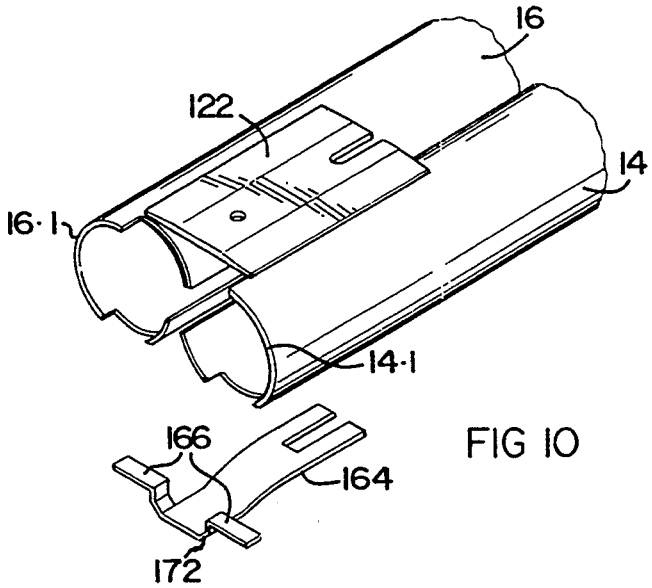
FIG. 10 shows an exploded three dimensional view of a further portion of the magazine of FIG. 9.
Figure 11:
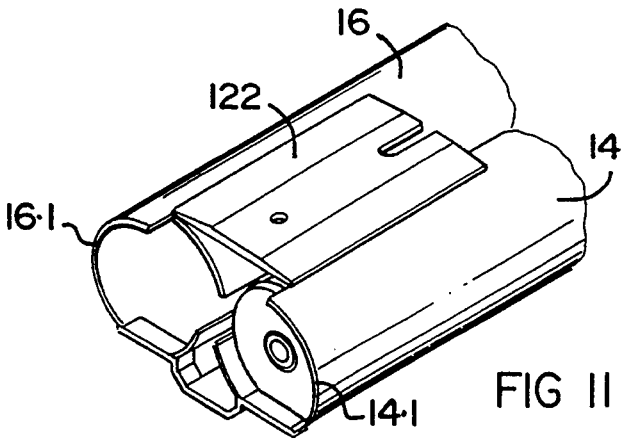
FIG. 11 shows a three dimensional assembled view of the portion of the magazine illustrated in FIG. 10.

Referring to FIGS. 10 and 11 the embodiment further includes an anti-double feed member 164. The anti-double feed member 164 includes laterally extending wing formations 166 engageable in complementary recesses in the walls of the tubular members 14, 16 at the open ends 14.1, 16.1. The member 164 which is made of a resiliently flexible material is secured by its leading end remote from the wing formations 166 to a lower surface of the pivot block 18 shown in FIGS. 13 and 14. In its inoperative state the wing formations 166 are located below the path of the cartridges to be ejected so as not to interfere with the ejection of the cartridges.

Referring to FIG. 14, when the barrel 40 is pumped to its forward position, laterally extending engagement formations 170 provided near a rearward end of the barrel 40 travel the length of the slots 158. Once the formations 170 reach front ends of the slots 158 they carry the sliding gate 100 with it causing the bridge 102 to engage first with a lower surface of a rearward end 172 of the anti-double feed member 164 thereby forcing the wing formations 166 into the path of the cartridges to be ejected. Further displacement of the sliding gate in a forward direction causes the bridge 102 to cam the downwardly extending end portion 104 of the shank 28 upwardly and to urge the wing formations 28.1, 28.2 downwardly out of the path of the cartridges in the tubular members 14, 16.

Figure 15:
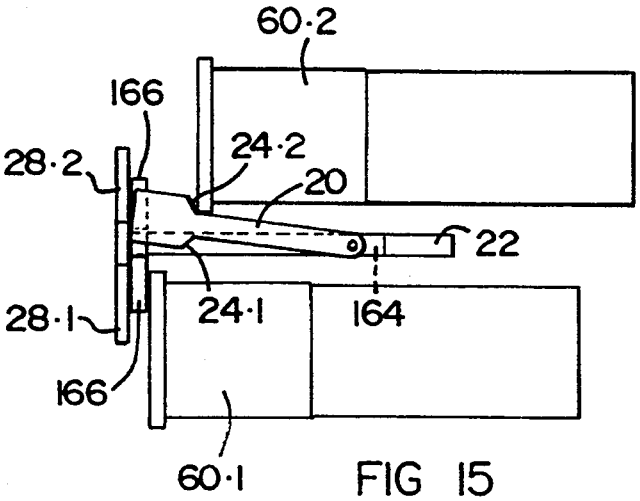
FIG. 15 is a schematic plan view illustrating the operation of a catch member used in the FIG. 9 embodiment.

Referring to FIG. 15 it will be appreciated that each cartridge ejected from the tubular members 14, 16 has to pass a set of three stop formations, namely one of the noses 24.1 or 24.2 of the catch member 20, one of the wing formations 166 of the anti-double feed member 164, and finally one of the wing formation 28.1 or 28.2 of the gate member 22.

When the selector 106 is positioned with the lever 110 in its central position, alternate feeding of cartridges from the tubular members 14, 16 takes place. During the alternate ejection of cartridges from the tubular members 14, 16, the catch member 20 swivels alternately to open the pathway to the one tubular member 14 or 16 and to penetrate the path of the cartridges of the other tubular member 16 or 14, and vice versa. The selector 106 is maintained in any one of its three positions by frictional engagement or, if desired, by a suitable detent (not shown).

When the catch member 20 is swivelled to the left hand side as viewed from the open ends 14.1, 16.1, and as illustrated in FIG. 15, the pathway of the cartridges in the tubular member 14 is opened. The nose formation 112 on the selector 106, like the nose formation 114, has a bevelled front end operable to cam the periphery of the rearmost cartridge 60.2 deeper into the tubular member 16 thereby to force the cartridge 60.2 behind the nose 24.2 of the catch member 20. The rearmost cartridge 60.1 in the tubular member 14 which is urged towards the open end 14.1 urges the catch member 20 to the left hand side thus allowing the cartridge 60.1 to proceed towards the open end 14.1. Assuming that the barrel 40 at this point is in its rearward position, the anti-double feed member 164 does not interfere with the path of the cartridges thus allowing the rearmost cartridge 60.1 from the member 14 to come to rest against the wing formation 28.1. Pumping of the barrel 40 to its forward position urges the wing formations 166 into the path of cartridges in the tubular members 14, 16. The extent of the protrusion of the wing formations 166 is however such as to permit interference only with a rim of a cartridge. Since the rim of the rearmost cartridge in the tubular member 14 has already passed its corresponding wing formation 166, it will not be affected by the anti-double feed member 164 and will be ejected from the tubular men%her 14 when the gate member 22 is swivelled out of the path of the tubular members 14, 16 by the camming action of the bridge 102.

The cartridge 60.1 ejected from the tubular member 14 strikes against the tripper member 142 to disengage the nose formations 146. This permits the feed member 62 to pivot in a clockwise direction urging the cartridge 60.1 downwardly onto the guide rails 154.

As the cartridge 60.1 leaves the tubular member 14, the rearmost cartridge 60.2 in the tubular member 16, is urged outwardly by its coil spring 44 and cams the nose 24.2 to move the catch member 20 to the right hand side thereby opening the path of the cartridge 60.2 allowing it to abut its corresponding wing formation 166. Once the barrel 40 is pumped rearwardly, the wing formations 166 move out of the path of the cartridges in the tubular men%bets 14, 16 to permit the cartridge 60.2 in the tubular member 16 to abut the wing formation 28.2. The cartridge 60.2 is thus now in an ejection position.

Each time the barrel is pumped rearwardly, the cam member 160 urges the feed member 62 to its inoperative position. The tripper member 142 in turn pivots in an anti-clockwise direction in its slots 144 to again allow the nose formations 146 to engage the feed member 62.

The remaining operations including the ejection of spent cartridges follow a sequence of steps similar to that described for the FIGS. 1 to 8 embodiment.

The invention thus provides a magazine 10 for a pump action firearm 12, which can hold a large number of cartridges when a plurality of tubular members 14, 16 are provided. Ejection of alternate cartridges from the tubular members 14 and 16 is readily controlled in a simple fashion. The magazine 10 is easily detached from the firearm to permit replacement with a fresh magazine 10. Cartridges are also easily loaded into the magazine 10 after detachment of the magazine 10 or by simply pivoting the magazine 10 while the engagement formation 50 engages the pin 52 (as shown in solid lines in FIG. 3). It will be noted that the tubular members 14 and 16 need not be loaded with the same number of cartridges as the magazine 10 will still operate to eject cartridges from one of the tubular members when the other is empty. The tubular members 14 and 16 can also be loaded with different types of cartridges and the selector 106 used to select the type of cartridge to be loaded. This makes the magazine 10 ideal for use under battle conditions.

What is claimed is:

1. A magazine for a firearm which includes a plurality of tubular members arranged in side by side relationship each capable of receiving a plurality of cartridges, the tubular members being displaceably mountable on the firearm to permit displacement between an inoperative position for receiving fresh cartridges and an operative position for dispensing cartridges from the tubular members into a barrel of the firearm;

a gate member pivotally mounted at an open end of the tubular members and having a protuberance in the path of an end cartridge to inhibit ejection of the cartridge from each tubular member, the gate member co-operating with a loading mechanism of the firearm and being operable to displace the gate member out of such path; and at least one catch member at an end region of the tubular members for preventing ejection of an end cartridge from one tubular member while a cartridge is being ejected from another tubular member, the catch member being pivotally mounted in a pivot block and being in the form of a plate having a nose on opposite sides of its end remote from its pivotal mounting, the plate being pivotable to cause each nose to project into the open end of one tubular member to prevent ejection of an end cartridge from that tubular member while an end cartridge from another tubular member is being ejected.

2. A magazine as claimed in claim 1, for use with a pump action firearm, wherein the gate member includes a shank pivotally mounted in the pivot block, the shank having at least one outwardly extending wing formation forming a protuberance in the path of the end cartridge in the each tubular member, the gate member having an actuating member operable, when the firearm is pumped, to displace the protuberance out of the path of the end cartridge.

3. A magazine as claimed in claim 1, which includes biassing means for urging the cartridges towards the open end of each tubular member, the biassing means being in the form of a piston housed in the tubular member and urged by a coil spring towards the open end of the tubular member.

4. A magazine as claimed in claim 1, wherein each tubular member has a loading catch biassed towards a latching position for retaining an end cartridge after it has been loaded into the tubular member, the loading catch being displaceable out of the path of the cartridge as the cartridge is being loaded into the tubular member.

5. A magazine as claimed in claim 1, which further includes an anti-double feed member for preventing the ejection of more than one cartridge from each tubular member when the gate member is displaced out of the path of the end cartridge, the anti-double feed member including a resiliently flexible plate having a pair of wing formations protruding into the path of the end cartridges and being displaceable out of such path by the loading mechanism.

6. A firearm, having a magazine as claimed in claim 1, and which includes guide rails for guiding cartridges ejected from the magazine prior to being inserted into a barrel of the firearm, and a feed member mounted rearwardly of the magazine and which is movable between inoperative and operative positions for urging cartridges ejected from the magazine onto the guide rails.

7. A firearm as claimed in claim 6, wherein the feed member is held in its inoperative position by a pivotable tripper mechanism which is mounted in the path of a cartridge being ejected from the magazine.

8. A magazine as claimed in claim 1, which includes a selector member which is displaceable from a neutral position allowing cartridges to be fed in succession from each of the tubular members, to at least one operative position wherein a projection on the selector member is displaced into the path of cartridges in a particular tubular member thereby to prevent ejection of cartridges from that tubular member.

* * * * *